United States Patent [19]

Adler

[11] 3,950,790

[45] Apr. 20, 1976

[54] NECKTIE

[75] Inventor: Robert H. Adler, Oceanside, N.Y.

[73] Assignee: Norvell Corporation, New York, N.Y.

[22] Filed: Sept. 2, 1975

[21] Appl. No.: 609,391

[52] U.S. Cl. ..... 2/144
[51] Int. Cl.[2] ..... A41D 25/00
[58] Field of Search ..... 2/144, 146, 155, 156, 2/157, 148, 150

[56] References Cited

UNITED STATES PATENTS

| | | | |
|---|---|---|---|
| 2,694,203 | 11/1954 | Sanford | 2/144 |
| 2,893,013 | 7/1959 | Miller | 2/146 |
| 3,358,291 | 12/1967 | Davidowitz et al. | 2/146 |

*Primary Examiner*—Geo. V. Larkin
*Attorney, Agent, or Firm*—John J. Hart

[57] ABSTRACT

The frontal long end of the necktie is composed of a lower long end section and an upper long end section. The upper section comprises a first piece constituted of a first fabric having an exposed given facing surface and formed to enable a slipknot to be made therewith. The lower section comprises an inner second piece constituted of said first fabric and an outer third piece superimposed on such second piece and constituted of a second fabric having an exposed facing surface different from that of the first fabric. Lines of stitching connect the side and bottom edges of the second and third piece together and the upper edges of such pieces to the bottom edge of the first piece to form the long end of the necktie. The portion of the inner second piece covered by the outer third piece has its facing surface directed inwardly and the second piece has a portion thereof extending beyond the bottom edge of the outer third piece and folded to form along such bottom edge a border having an exposed facing surface different from the exposed facing surface of the third piece and similar to the exposed facing surface of the first piece. The seam connecting the bottom edges of the second and third pieces is spaced inwardly from the fold in the extended portion of the second piece.

4 Claims, 5 Drawing Figures

NECKTIE

This invention relates to neckties and its principal object is to provide a novel necktie construction which enables the production of new necktie designs heretofore unattainable with known methods of making neckties.

In accordance with the invention the exposed long end section of the necktie is composed of two facing fabrics of different patterns and/or coloring, one of which fabrics when the necktie is constructed as a four-in-hand necktie and tied in the usual fashion, is exposed both in the slipknot, a portion of the long end section adjacent to the slipknot and an end border on such end section, and the other of which fabrics is exposed in the remainder of the long end section.

For a better understanding of the necktie of this invention, reference is made to the following description which should be considered in connection with the accompanying drawings, in which FIG. 1 illustrates a finished necktie embodying the invention as typically worn;

Figure 1:
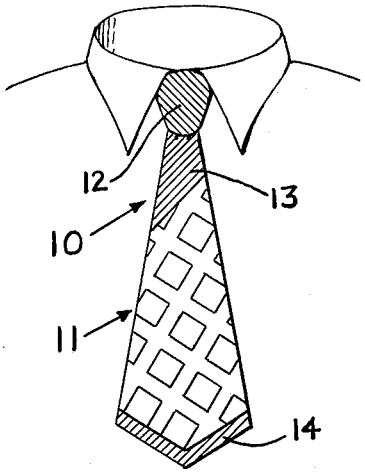

FIG. 1 of the drawings shows a four-in-hand necktie knotted in the customary fashion and in accordance with the invention made of two fabrics 10 and 11 of different colors and patterns. The fabric 10 constitutes the basic fabric of the necktie and estends the entire extends of the necktie. The facing side of the fabric 10 is exteriorly exposed throughout the length of the necktie except for that section of the necktie in which is exposed the facing side of the fabric 11. In such section of the necktie, the fabric 10 forms a lining for the fabric 11 and the facing side of such lining portion thereof is turned inwardly. The two fabrics 10 and 11 are assembled in such manner that when the necktie is worn by the user as indicated, the fabric 10 is exposed in the slipknot 12, in that portion 13 of the long end section which extends below the slipknot, and in a V-shaped end portion 14 at the lower free end of the long end section. The fabric 11 is exposed in the long end section between the portion 13 of such section below the slipknot and the V-shaped end portion 14 of such section. Because of the differences in the colors and patterns of the two fabrics 10 and 11, the resulting necktie design is original and striking. By varying the colorings of the two fabrics without changing the designs, or by varying the designs and/or colorings a wide variety of novel necktie effects can be produced.

Figure 2:
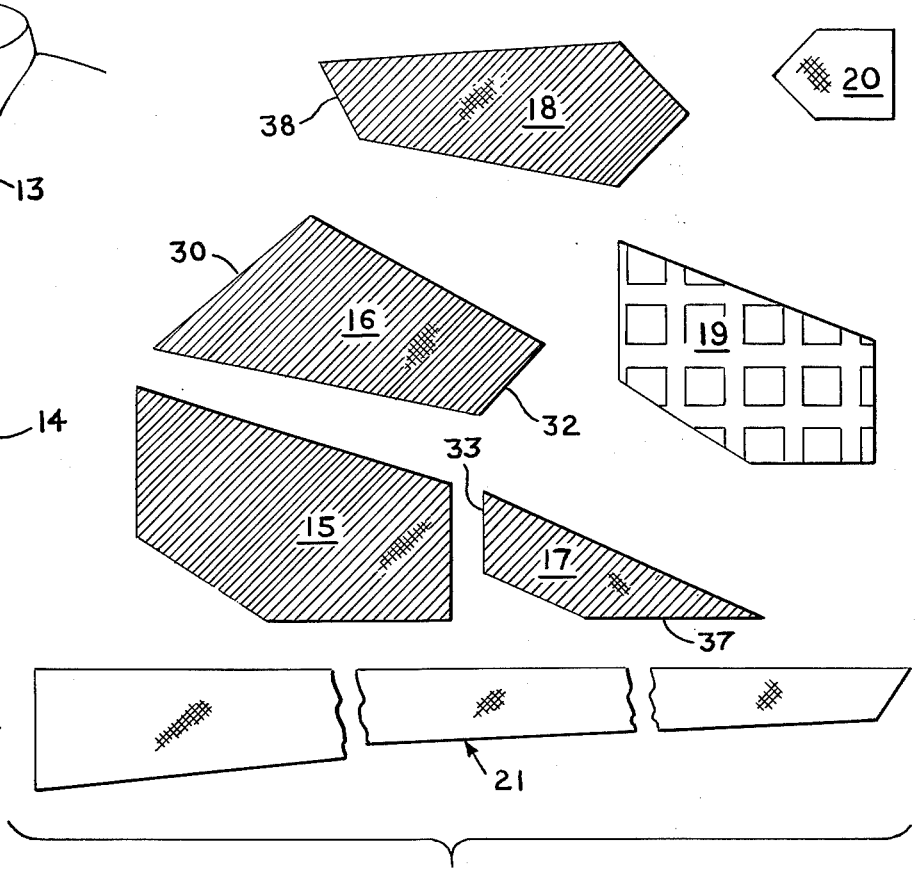
FIG. 2 is an exploded view showing the pieces of fabric that comprise the necktie.

As is shown in FIG. 2 of the drawings, the necktie is composed of a lower long end piece 15, an upper long end piece 16, a neck piece 17 and a short end piece 18 all made of the fabric 10. A lower long end piece 19 is made of the fabric 11. The reference numeral 20 designates a white end piece which forms a lining for the outer end portion of the short end piece 18. Extending throughout the interior of the necktie for the major portion of its length is the customary strip 21 of ticking to serve as a reinforcement for the fabrics 10 an 11 so as to maintain the form and shape of the necktie during its usage.

Figure 5:
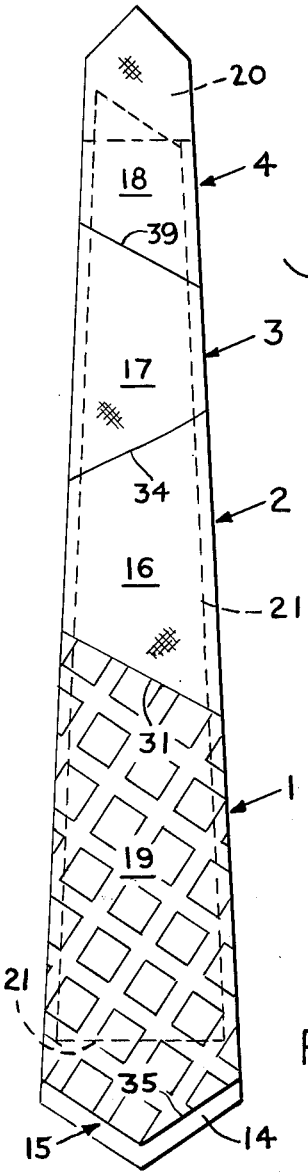
FIG. 5 is a plan view of the assembled necktie sections.
Figure 3:
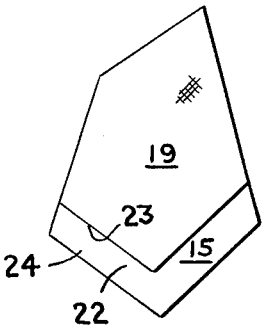
FIG. 3 is a plan view of the two superimposed pieces from which the lower portion of the long end of the necktie is formed; the two pieces being shown unstitched to illustrate their relative sizes.
Figure 4:
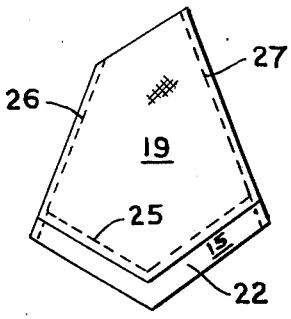
FIG. 4 is a view similar to FIG. 3 showing the two pieces stitched together.

In constructing the necktie from the pieces shown in FIG. 2 of the drawings, the piece 15 is placed face up on a support such as a table and the piece 19 is placed face down upon the piece 15. It will be observed from FIGS. 2 and 3 of the drawings, that the two pieces 15 and 19 are substantially similarly shaped and differ only in that the V-shaped lower end of piece 15 extends downwardly beyond the lower V-shaped end of the piece 19 to provide a lower V-shaped extension 22, in FIG. 3, of fabric 10. The extension 22 has a width twice the width of the V-shaped portion 14 shown in FIG. 1 of the drawings. The two pieces are connected by first sewing the lower V-shaped edges 23 and 24 together by a line of stitching 25, then drawing up the piece 19 to double the extension 22 thus reducing its width by half, and then sewing the side edges of the two pieces together by the two lines of stitches 26 and 27 which extend down into the doubled extension 22 and close the open ends thereof as shown in FIG. 4 of the drawings. As a result of this construction the seam 35 in FIG. 5 formed by the line of stitching 25 in connecting the edges 23 and 24 together will be spaced upwardly from the fold formed in the extension 22. The two sewn pieces 15 and 19 are then turned inside out and ironed to form the necktie section 1 shown in FIG. 5 of the drawings. As will be understood from the foregoing, such section 1 is composed of the outer piece 19 of fabric 11 with its facing exposed, and the inner piece 15 of fabric 10 which in effect forms a lining for the outer piece 19 and which at its lower end is doubled to form the V-shaped necktie end portion 14. The facing side of the inner piece 15 is directed inwardly except for the exposed folded side of the end portion 14. While for the purposes of illustration, the dimensions of the two pieces 15 and 19 have been selected to provide a border 14 of contrasting fabric material 10 along the bottom edges of the piece 19 of fabric 11, it will be understood that such dimensions may be so selected and assembled in the manner above described with respect to the edges 23 and 24 of such pieces, as to provide straight borders along one or both sides of the piece 19 of fabric 11. Thus, several variations in the construction of the necktie, as well as in the colors and patterns thereof may be produced to obtain a wide variety of style effects.

As has been indicated the necktie section 1 forms the lower portion of the long end piece of the necktie. The upper portion of such long end piece which is designated in FIG. 5 of the drawings of the necktie section 2, is formed from the piece 16 of fabric 10. In constructing section 2, the piece 16 is placed face down on the facing of piece 19 with the edge 30 thereof in registry with the upper unsewn edges of the pieces 15 and 19 and the three pieces are sewn together to form the seam 31 shown in FIG. 5 of the drawings. The edge 30 of piece 16 has a length equal to that of the upper edges of the pieces 15 and 19. The width of the piece 16 tapers upwardly to provide a shorter upper edge 32 which is sewn to the edge 33 of the piece 17 while the piece 17 is placed face down on the piece 16 to form the seam 34 in FIG. 5 connecting the necktie section 2 to the necktie section 3. The edges 32, 33 of the pieces 16, 17, respectively, are of the same length and the width of the piece 17 is substantially uniform. The tie section 3 formed by the piece 17 fits around the neck of the user when the tie is worn.

The body of the necktie is completed by sewing the edge 38 of piece 18 to the edge 37 of piece 17 while the facing sides of such two pieces are opposed to form the seal 39 connecting the necktie section 4 forming the short end of the necktie to the neck section 3. The two edges 37 and 38 are of equal length and form the seam 39 connecting the same. The piece 18 flares outwardly in the usual manner and the outer end portion of the piece 18 has connected to it in the usual manner the white end piece 20 which forms a lining in such outer end portion.

The structure of the necktie may be completed by placing the facing sides of the connected sections 1–4 downwardly on a support and superimposing thereon the strip 21 of ticking material. The strip 21 is positioned centrally of the connected sections and then the projecting edge portions of such sections are turned inwardly so that the edges thereof overlap along the longitudinal axis of the construction. The overlapped edges are connected together by a longitudinal line of stitching and the necktie finished in accordance with customary practice.

I claim:

1. A necktie having a frontal long end composed of a lower long end section and an upper long end section, said upper section comprising a first piece constituted of a first fabric having an exposed given facing surface and formed to enable a slipknot to be made therewith, said lower section comprising an inner second piece constituted of said first fabric and an outer third piece superimposed on said second piece and constituted of a second fabric having an exposed facing surface different from that of said first fabric, means connecting said second and third pieces together and said second and third pieces to the lower edge of said first piece to form the long end of the necktie, the portion of said inner second piece covered by said outer third piece having its facing surface directed inwardly and said second piece having a portion thereof extending beyond an edge of said outer third piece and being folded to form along such third piece edge a border having an exposed facing surface different from the exposed facing surface of said third piece and similar to the exposed facing surface of said first piece.

2. A necktie as defined in claim 1, in which said upper section is long enough to enable the lower end thereof to be disposed below a slipknot made thereby, whereby the slipknot and the portion of the necktie adjacently below the slipknot both have an expose facing surface similar to that of said border.

3. A necktie as defined in claim 1, in which the folded extended portion of said inner second piece projects beyond the bottom edge of said outer third piece to locate the exposed facing surface of said third piece between the exposed similar facing surfaces of said first piece and of said border formed by said folded extended second piece portion.

4. A necktie as defined in claim 1, in which said connecting means comprises a line of stitching connecting said outer third piece edge to the associated edge of said second piece extended portion, the seam formed by said line of stitching being spaced inwardly from the fold in said second piece extended portion.

* * * * *